US007060220B2

(12) United States Patent
Nakashima

(10) Patent No.: US 7,060,220 B2
(45) Date of Patent: Jun. 13, 2006

(54) METAL MELTING FURNACE

(75) Inventor: Mitsukane Nakashima, Aichi (JP)

(73) Assignee: Kabushiki Kaisha Meichu, Aichi-ken (JP)

( * ) Notice: Subject to any disclaimer, the term of this patent is extended or adjusted under 35 U.S.C. 154(b) by 0 days.

(21) Appl. No.: 10/790,098

(22) Filed: Mar. 2, 2004

(65) Prior Publication Data

US 2004/0217526 A1 Nov. 4, 2004

(30) Foreign Application Priority Data

Apr. 30, 2003 (JP) ..... 2003-125154

(51) Int. Cl.
*C21C 7/00* (2006.01)
*C21B 7/00* (2006.01)

(52) U.S. Cl. ..... 266/229; 266/242; 266/900

(58) Field of Classification Search ..... 266/229, 266/242, 900, 901
See application file for complete search history.

(56) References Cited

U.S. PATENT DOCUMENTS 3,809,378 A * 5/1974 Iida ..... 266/901
4,850,577 A * 7/1989 Yamaoka ..... 266/229
4,974,817 A * 12/1990 Nakashima ..... 266/901

FOREIGN PATENT DOCUMENTS

JP 408049979 A * 2/1996 ..... 266/900
JP 3225000 B2 5/2001
JP 02002213877 A * 7/2002 ..... 266/242

* cited by examiner

*Primary Examiner*—Scott Kastler
(74) *Attorney, Agent, or Firm*—Rader, Fishman & Grauer

(57) ABSTRACT

In a metal melting furnace, a separation wall 60 is provided between an inclined hearth 30 and a molten metal reservoir 35 to define a molten metal processing portion 65. The separation wall is provided with a connecting passage 61 for the molten metal, between the molten metal reservoir and the molten metal processing portion, at a height level higher than a bottom surface 67 of the molten metal processing portion. The separation wall is also provided on its upper portion with an exhaust gas passage which permits exhaust gas discharged from the molten metal reservoir to pass therethrough. An inspection opening 31 with a door 32 is provided in a furnace wall surface 37W to open into the molten metal processing portion.

6 Claims, 4 Drawing Sheets

METAL MELTING FURNACE

BACKGROUND OF THE INVENTION

1. Field of the Invention

The present invention relates to a melting furnace for a metal such as aluminum.

2. Description of the Related Art

The inventor of the present invention has proposed a metal melting furnace 100 as shown in FIGS. 5 to 7. In FIGS. 5 to 7, a metal melting furnace is comprised of a preheating flue 120 which is provided, on its upper end, with a material inlet opening 121 through which a meltable material is introduced in the preheating flue 120 and, on its lower end, with an inclined hearth 130. The meltable material (metal) introduced in the preheating flue 120 is heated and molten by a melting burner 125 which is oriented toward the lower end of the preheating flue 120. The molten metal is introduced in a molten metal reservoir 135 through the inclined hearth 130.

The temperature of the molten metal M in the reservoir 135 is maintained at a predetermined value by a temperature maintaining burner 136. A meltable material holder 150 having an open lower end is provided in the preheating flue 120, so that there is a gap C between the meltable material holder 150 and the inner furnace wall 122W of the preheating flue 120 that is located on the side opposite to the melting burner 125 (e.g., see Japanese Patent No. 3,225,000 (page 3 and FIGS. 1 to 3)).

In FIGS. 5 to 7, numeral 122 designates the furnace wall which constitutes the preheating flue 120, 123 the operation inspecting hole formed in the furnace wall 122, 124 the door thereof, 126 the separation wall between the preheating flue 120 and the molten metal reservoir 135, 127 the connecting passage formed in the separation wall 126, and 155 the flange provided at the upper end of the meltable material holder 150.

In connection with the molten metal reservoir 135, numeral 137 designates the furnace wall which forms the molten metal reservoir 135, 138 the operation inspecting hole formed in the furnace wall 137, 139 the door thereof, 140 the molten metal discharge portion, 141 the connecting passage formed in a separation wall between the molten metal reservoir 135 and the molten metal discharge portion 140.

In the metal melting furnace 100 constructed as above, as the gap C is provided between the meltable material holder 150 in the preheating flue 120 and the furnace wall surface 122W of the flue 120 on the opposite side to the metal melting burner 125, no meltable material sticks to the furnace wall surface 122W in the meltable material holder 150 and stays in the flue 120. Thus, the problems that the meltable material sticks to the flue and stays in the flue 120 and that were unavoidable in the prior art can be fundamentally eliminated.

Consequently, it is no longer necessary for an operator to perform troublesome routine operations, such as removal of the meltable material which sticks to the inner furnace wall surface 122W of the preheating flue 120 or the hearth 130 and which stays in the flue or on the hearth or cleaning of the flue, etc. Moreover, not only can the durability of the furnace body itself be enhanced, but also the thermal efficiency to the meltable material can be enhanced, thus leading to high productivity.

In the melting furnace 100 mentioned above, however, there is another problem that impurities such as oxide, in the molten metal reservoir 135 must be removed. Namely, impurities such as oxides of various metals contained in the meltable material or non-metallic inclusions are produced during the melting process of the meltable material and are mixed in the molten metal. It is impossible to obtain a clean molten metal without removing the impurities and, accordingly, the quality of a final mold product cannot be enhanced. To this end, in the known metal melting furnace 100, a reactive additive (flux) is introduced in the molten metal in the molten metal reservoir 135 so as to coagulate the impurities and remove them as dross.

However, the removal of the impurities in the molten metal reservoir 135 requires extremely complicated operations to spread the flux on the molten metal surface 135, to stir the molten metal, and to remove the dross using a scraping rod inserted in the operation inspecting hole 138 after the movement of the molten metal has completely ceased. The flux often contains harmful components, such as chlorine or fluorine, which emits smoke (gas) or irritant odor during operation, and thus, the operating environment is strictly restricted.

Usually, the removal of impurities using the flux is conducted at intervals of 8 hours. Nevertheless, due to the complexity of the operations, it is difficult to remove the impurities completely and thus, a part of the impurities reaches the discharge portion 140, and consequently, the quality of the molten metal is deteriorated. Furthermore, the heavy metal oxide settles to the bottom of the molten metal reservoir 135 and forms a deposit which reduces the amount of molten metal which can be stored in the molten metal reservoir 135.

In view of these problems, there is long need in the industry of the filed that the operation to remove the impurities or the like in the metal melting and reserving furnace be simplified. In particular, improved use or reduction of the flux has been highly needed.

SUMMARY OF THE INVENTION

It is an object of the present invention to provide an improved metal melting furnace in which impurities, such as a metal oxide, which can be easily removed and no or little flux is used, whereby a cleaner molten metal can be obtained.

To achieve the object mentioned above, according to an aspect of the present invention, there is provided a metal melting furnace comprising a preheating flue which is provided on its upper portion with a meltable material inlet opening and on its lower portion with an inclined hearth and a material melting burner which is oriented toward the lower portion of the preheating flue, a molten metal reservoir, and a temperature maintaining burner which provided in the molten metal reservoir, so that a meltable material which is introduced in the preheating flue is heated and melted by the material melting burner and is moved along and on the inclined hearth into the molten metal reservoir in which the temperature of the molten metal is maintained by the temperature maintaining burner, wherein a separation wall is provided between the inclined hearth and the molten metal reservoir to define a molten metal processing portion, said separation wall being provided with a connecting passage for the molten metal, between the molten metal reservoir and the molten metal processing portion, at a height level higher than a bottom surface of the molten metal processing portion, said separation wall being provided on its upper portion with an exhaust gas passage which permits exhaust gas discharged from the molten metal reservoir to pass therethrough, and wherein an inspection opening with a door is provided in a furnace wall surface to open into the molten metal processing portion.

In an embodiment, a bottom surface of the molten metal reservoir is substantially flush with the lower side of the connecting passage for the molten metal.

A metal melting furnace can be further comprised of a meltable material holder having an open lower end, which is provided in the preheating flue and is spaced at least from the wall surface of the preheating flue that is located on the opposite side to the material melting burner.

A metal melting furnace can be further comprised of a meltable material holder having an open lower end, which is provided in the preheating flue and is spaced from the entire peripheral wall surface of the preheating flue.

The meltable material holder can be made of, for example, a cylindrical sleeve.

The inclined hearth can be defined by a continuously inclined surface toward the molten metal processing portion.

DESCRIPTION OF THE PREFERRED EMBODIMENT

Figure 1:
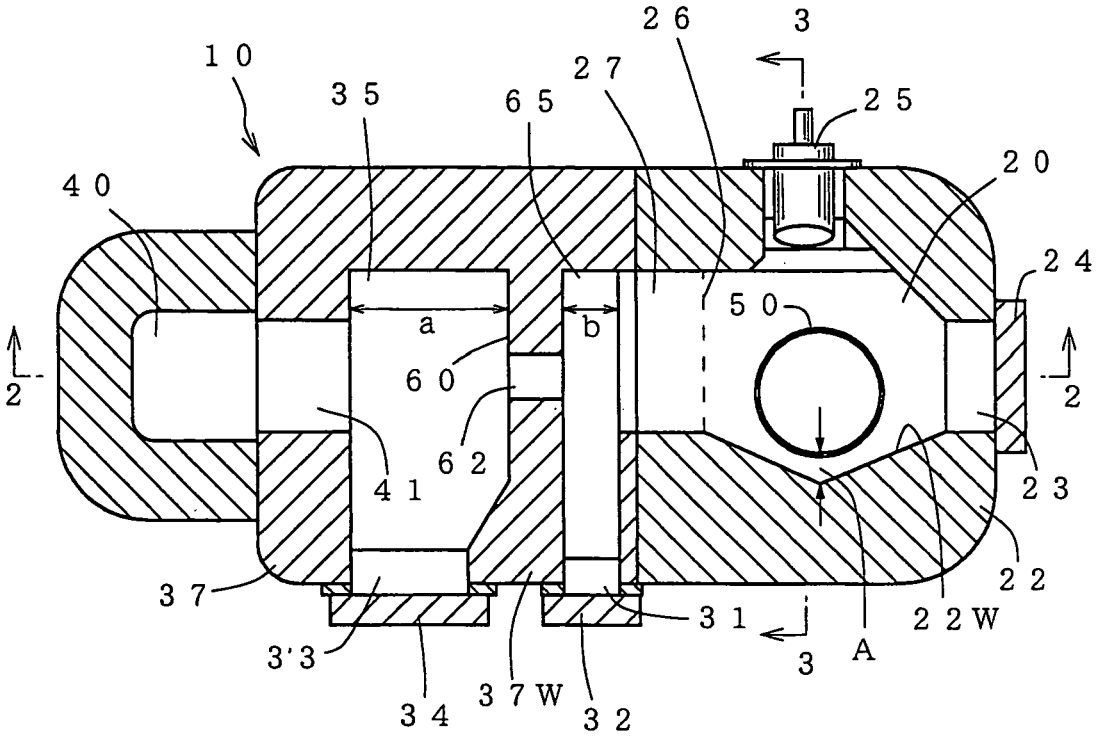
FIG. 1 generally shows a cross sectional view of a metal melting furnace according to an embodiment of the present invention.
Figure 2:
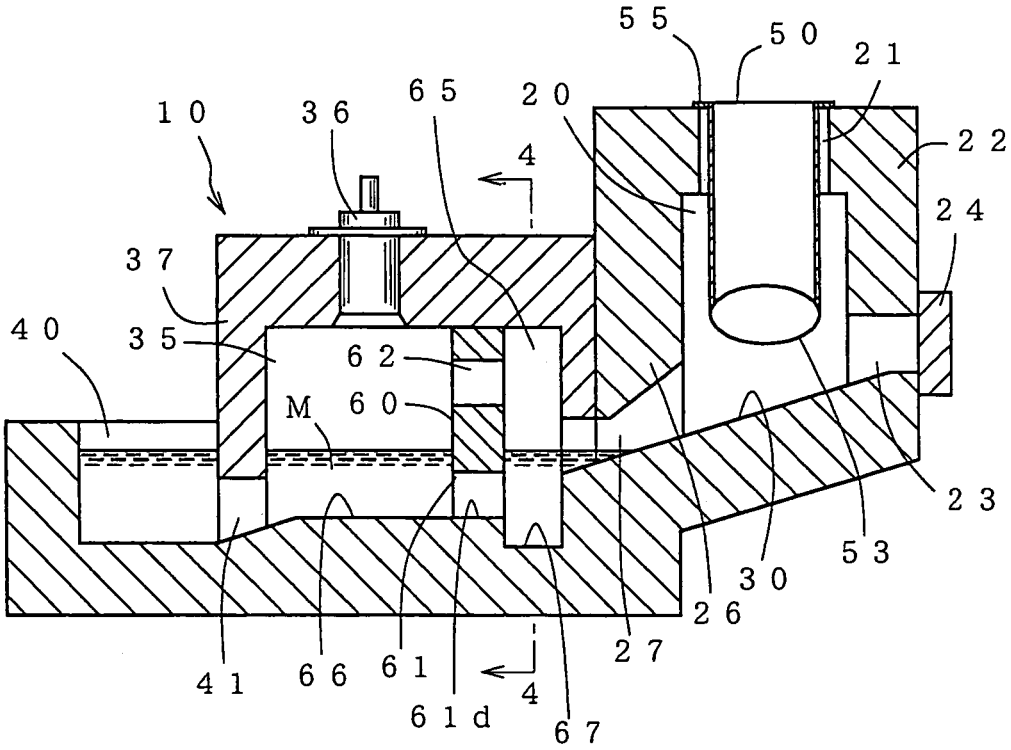
FIG. 2 is a sectional view taken along the line 2—2 in FIG. 1.
Figure 3:
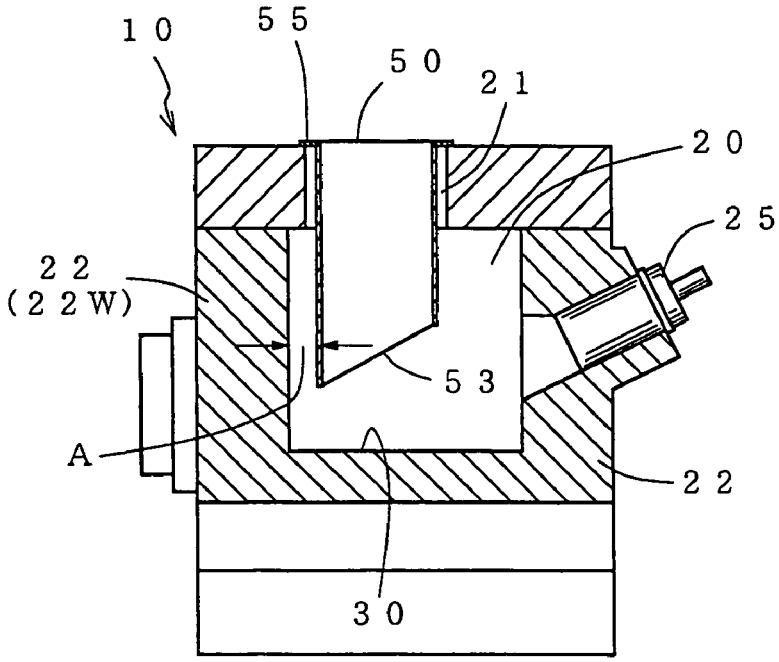
FIG. 3 is an enlarged sectional view taken along the line 3—3 in FIG. 1.
Figure 4:
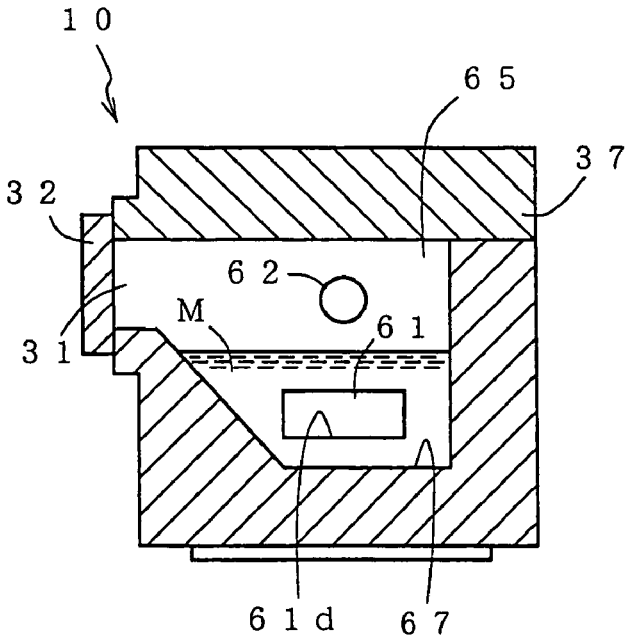
FIG. 4 is a sectional view taken along the line 4—4 in FIG. 2.
Figure 5:
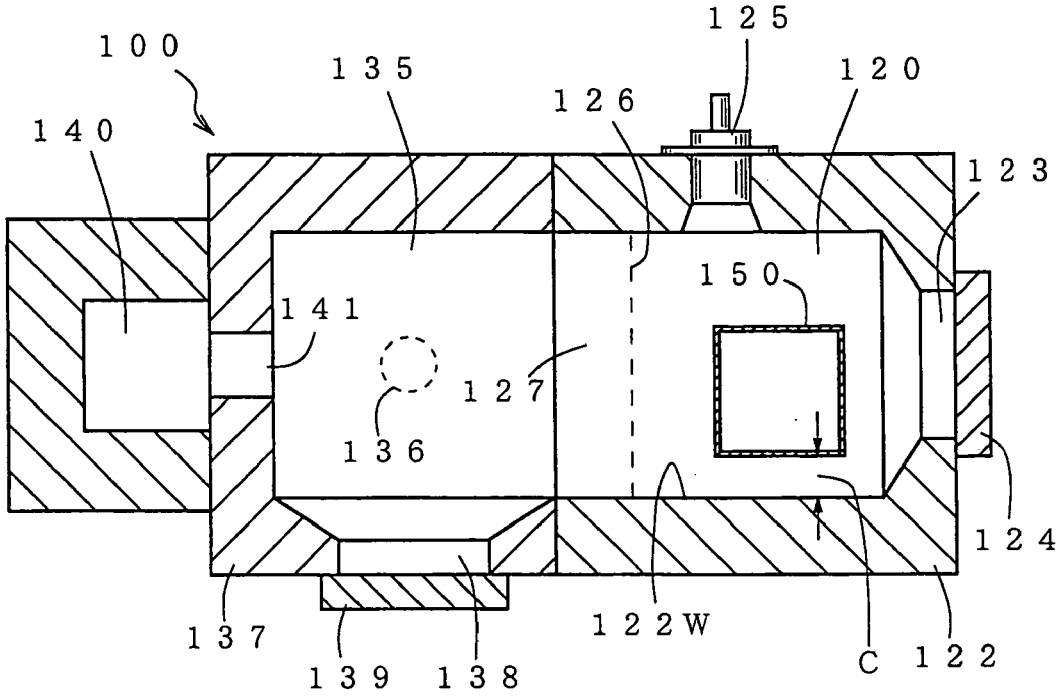
Prior Art FIG.5
FIG. 5 generally shows a cross sectional view of a known metal melting furnace by way of example.
Figure 6:
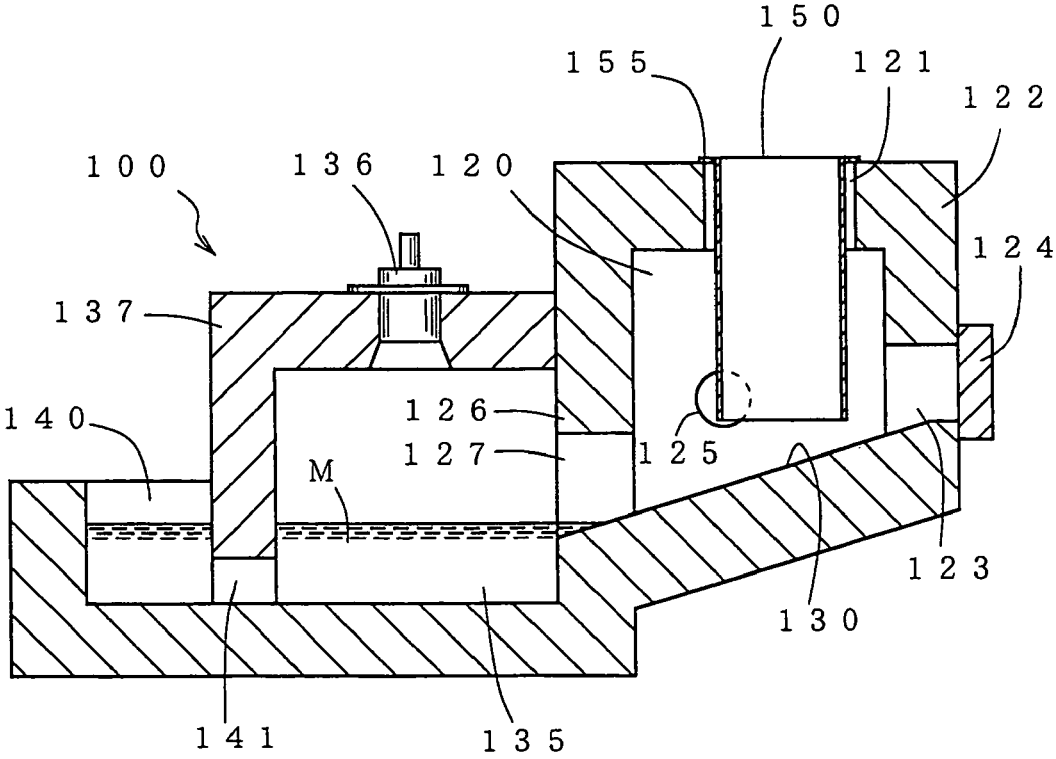
Prior Art FIG.6
FIG. 6 is a longitudinal sectional view of FIG. 5.
Figure 7:
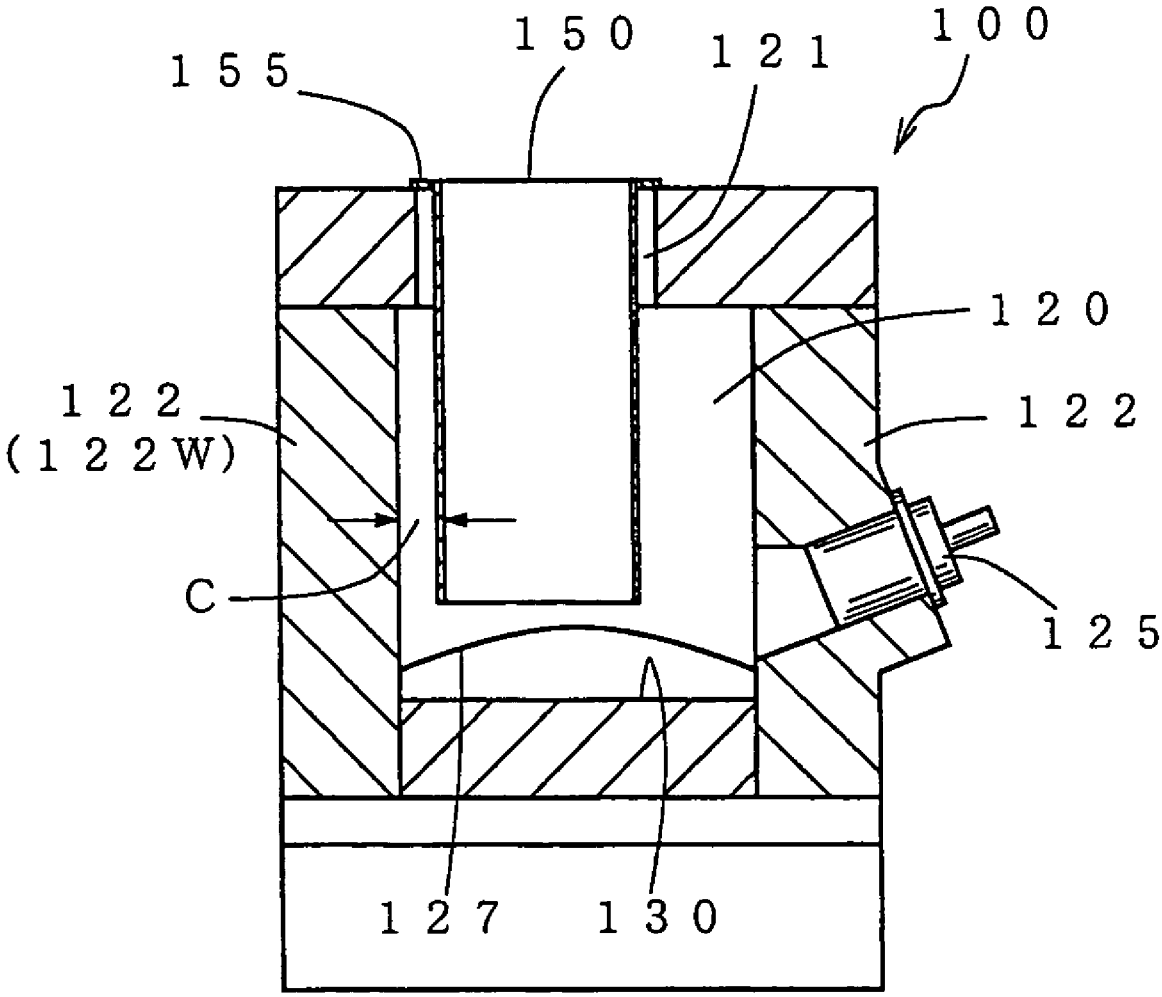
Prior Art FIG.7
FIG. 7 is a longitudinal sectional view of a preheating flue shown in FIG. 5.

A metal melting furnace 10 according to an embodiment of the present invention is a furnace in which an aluminum for casting is molten and held. As can be seen in FIGS. 1 through 4, a meltable material is introduced in a preheating flue 20 which is provided, on its upper end, a material inlet opening 21 (which also serves as an air discharge opening) and, on its lower end, with an inclined hearth 30. The introduced material is heated and molten by a melting burner 25 which is oriented toward the lower portion of the preheating flue 20.

The molten metal is introduced into a molten metal reservoir 35 from the inclined hearth 30. In the molten metal reservoir 35, the internal molten metal M is heated by a temperature maintaining burner 36 to maintain the molten metal at a predetermined temperature. The metal melting furnace constructed as above is generally called a dry hearth furnace.

In the drawings, numeral 22 and 26 designate the furnace walls which constitute the preheating flue 20, 23 the operation inspecting hole formed in the furnace wall 22, 24 the door thereof, 27 the connecting passage formed in the furnace wall 26. Also, in connection with the molten metal reservoir 35, numeral 33 the operation inspecting hole of the molten metal reservoir 35, 34 the door thereof, 37 the furnace wall which constitutes the molten metal reservoir, 40 the molten metal discharge portion, and 41 the connecting passage formed in the lower portion of the separation wall between the molten metal reservoir 35 and the molten metal discharge portion 40.

In the metal melting furnace 10 constructed as above, a separation wall 60 is provided between the inclined hearth 30 and the molten metal reservoir 35 to define a molten metal processing portion 65. The separation wall 60 is provided, on its lower portion located higher than the bottom surface 67 of the molten metal processing portion 65, with a connecting passage 61 connecting the molten metal reservoir 35 and the molten metal processing portion 65.

The separation wall 60 is also provided on its upper portion with an exhaust gas passage 62 for an exhaust gas discharged from the molten metal reservoir 35. Furthermore, the wall surface 37W which faces the molten metal processing portion 65 is provided with an operation inspecting hole 31 and a door 32 thereof.

Namely, in this invention, the meltable material which moves downward along and on the inclined hearth 30 is not directly introduced into the molten metal reservoir 35 but is stored once in the molten metal processing portion 65, so that the clean molten metal M only can be introduced into the molten metal reservoir 35 through the connecting passage 61 formed in the lower end of the separation wall 60.

Impurities, such as various metal oxides, produced in accordance with the melting of the meltable material are mixed and dispersed in the molten metal M. As mentioned hereinbefore, the flux mentioned above has been used to coagulate the impurities in order to easily remove them. In the present invention, however, the impurities are collected in the molten metal processing portion 65 before they are dispersed in the molten metal M of the molten metal reservoir 35, so that the impurities can be easily removed.

It is preferable that the volume of the molten metal processing portion 65 be relatively small, for easy removal of the impurities. In the illustrated embodiment, assuming that the length "a" of the molten metal reservoir 35 is 550 mm (width is 1,000 mm), the length "b" of the molten metal processing portion 65 is 200 mm (width is 1,000 mm), so that the volume of the molten metal processing portion 65 is less than half the volume of the molten metal reservoir 35.

Among the impurities, a heavy metal oxide tends to settle in the molten metal M, over time, and be deposited on the bottom surface 67 of the molten metal processing portion 65. In view of the deposition of the impurities, the connecting passage 61 formed in the separation wall 60 is located at a level higher than the bottom surface 67 of the molten metal processing portion 65. In the illustrated embodiment, the lower side 61*d* of the connecting passage 61 is located at a level higher by 100 mm than the bottom surface 67 of the molten metal processing portion 65.

To inspect and remove the impurities, the inspection opening 31 with the door 32 is provided in the furnace wall 37W. In the illustrated embodiment, the inspection opening 31 whose width is the same as the length "b" of the molten metal processing portion 65, so that the impurities such as metal oxides can be easily scraped and removed by a scraper rod (not shown) from the inner surface of the separation wall 60.

The exhaust gas passage 62 formed in the separation wall 60 is adapted to feed the exhaust gas throughout the furnace in order to effectively utilize the exhaust gas discharged from the molten metal reservoir 35. The air heated by the temperature maintaining burner 36 provided in the molten metal reservoir 35 is used to maintain the temperature of the molten metal M in the molten metal reservoir 35 at a constant value and is fed as exhaust gas through the exhaust gas passage 62 of the separation wall 60 into the molten metal processing portion 65 and the preheating flue 20 and is discharged to the outside from the material inlet opening 21 which serves also as an exhaust port.

The exhaust gas passage 62 is in the form of a circular hole having a diameter of 150 mm in the illustrated embodiment, but is not limited thereto. The shape and size of the passage 62 can be appropriately selected. If necessary, the upper portion of the separation wall is entirely open to define the exhaust gas passage 62. As a matter of course, the exhaust gas passage 62 is located higher than the surface level of the molten metal M.

As can be understood from the foregoing, as the meltable material moving down on the inclined hearth 30 is once stored in the molten metal processing portion 65, it is possible to prevent the impurities from being directly introduced in the molten metal reservoir 35. In particular, as the impurities, such as metal oxides, contained in the meltable material moving downward on the inclined hearth 30 are collected on the surface of the molten metal M in the molten metal processing portion 65, only the clean molten metal M can be fed to the molten metal reservoir 35 through the connecting passage 61 at the lower portion of the separation wall 60. As a result, the purity of the molten metal M in the molten metal reservoir 35 can be enhanced, so that the quality of the molten metal fed to molding dies or the like from the discharge portion 40 can be increased.

The impurities such as metal oxides, collected in the molten metal processing portion 65 can be easily removed. In particular, the impurities collected on the surface of the molten metal M can be discharged without using a flux. In the illustrated embodiment, the impurities are scraped and removed from the inspection opening 31 without using a flux, at time intervals of eight hours. Little impurity is introduced into the molten metal reservoir 35 by periodically scraping and removing the impurities in the molten metal processing portion 65 and accordingly no or little operation to introduce a flux in the molten metal so as to easily remove the impurities are necessary. Regardless of presence or absence of the introduction of the flux, the amount of impurities fed into the molten metal reservoir 35 can be remarkably reduced. In accordance with need, a flux can be used, but nevertheless, the number of use of flux can be reduced to, for example, once a week.

The impurities deposited on the bottom surface 67 of the molten metal processing portion 65, over time, can be removed when the furnace is cleaned every few months. In connection with the removal of the deposited impurities, it is preferable that the bottom surface 66 of the molten metal reservoir 35 be substantially flush with the lower side 61*d* of the connecting passage 61. With this arrangement, if the impurities are stuck to the bottom surface 66 of the molten metal reservoir 35 or the lower side 61*d* of the connecting passage 61, the impurities can be easily removed upon cleaning the furnace.

Furthermore, the arrangement in which the bottom surf ace 66 of the molten metal reservoir 35 is substantially flush with the lower side 61*d* of the connecting passage 61 not only simplifies the design and structure of the furnace, but also enhances the strength and durability of the separation wall 60.

In the metal melting furnace 10 in the illustrated embodiment, a meltable material holder 50 having an open lower end is provided in the preheating flue 20 so that a gap "A" is provided at least between the meltable material holder 50 and the furnace wall surface 22W of the preheating flue 20 on the opposite side to the metal melting burner 25. As mentioned above, this furnace structure contributes to facilitation of the troublesome operations to remove the residual non-molten material in the preheating furnace 20 and to clean the furnace, thus resulting in an enhanced durability of the furnace body and the thermal efficiency thereof to the meltable material. As a result, the productivity and the operation efficiency of the furnace can be enhanced.

Note that, in the metal melting furnace 10 in the illustrated embodiment, the meltable material holder 50 is spaced from all the surrounding wall surfaces 22 of the preheating flue 20.

It is preferable that the gap "A" between the melting metal holder 50 and the wall surface 22W of the preheating flue 20 opposite to the metal melting furnace 25 be more than approximately 50 mm. The gap between the melting metal holder 50 and the other wall surface of the preheating flue 20 can be determined depending on the size of the furnace or the power of the burner and can be more than 200 mm or 300 mm. In order to increase the heating efficiency of the material, it is advisable that the gap is relatively large.

The meltable material holder 50 can be of any shape which can receive therein a meltable material and is preferably in the form of a cylindrical sleeve. In particular, if the meltable material holder 50 is provided at its upper end with a flange 55 which covers the upper open end edge of the meltable material inlet opening 21, not only can the meltable material be easily and certainly introduced in the meltable material holder 50, but also the inlet opening 21 can be prevented from being damaged or contacted by the meltable material.

Moreover, the mounting of the meltable material holder 50 by hanging or replacement thereof can be easily carried out and the gap between the meltable material holder 50 of the flue 20 and the meltable material inlet opening can be easily controlled. Note that although the meltable material holder 50 is in the form of a cylindrical sleeve made of stainless steel plate having a thickness of approximately 10 mm in the illustrated embodiment, the cylindrical sleeve can be replaced with, for example, a porous, a net, or a frame member.

The meltable material holder 50 is provided, on the lower end portion adjacent to the material melting burner 25, with a cut-away portion 53 which makes it possible, on one hand, to directly hit the hot flame of the burner 25 against the meltable material in the holder 50 and, on the other hand, to protect the lower end portion of the meltable material holder 50 on the melting burner 25 side from being directly hit by the hot flame.

The inclined hearth 30 which extends from the lower end of the flue 20 molten metal processing portion 65 can be made of a continuously inclined surface which contributes to simplification of design of the furnace and facilitation of the inspection and cleaning operation of the furnace. Among others, the overall height of the furnace can be reduced, which is convenient to a user.

As may be understood from the above discussion, according to the present invention, as the separation wall is provided between the inclined hearth and the molten metal holder to define the molten metal processing portion, no impurity can directly enter the molten metal reservoir, so that only the clean molten metal can be introduced into the molten metal reservoir through the connecting passage at the lower end of the separation wall. Consequently, the purity of the molten metal in the molten metal reservoir can be remarkably increased.

The impurities stuck to the surface of the molten metal in the molten metal processing portion can be removed without using a flux. Little impurity enters the molten metal reservoir or the amount of the molten metal entering the molten metal reservoir is extremely small in comparison with the prior art. The number of operations to mix a flux into the impurities to thereby remove the same can be remarkably reduced or can be almost zero.

As the connecting passage for the molten metal is located higher than the bottom surface of the molten metal processing portion, if the impurities are collected and deposited on the bottom surface of the molten metal processing portion, over time, it is possible to feed a clean molten metal into the molten metal reservoir, so that the purity of the molten metal in the molten metal reservoir can be maintained for long time.

Furthermore, if the impurities are stuck to the bottom surface of the molten metal reservoir or to the lower side of the connecting passage for the molten metal, the impurities can be easily removed and discharged upon cleaning of the furnace. Moreover, not only can the design and structure of the furnace be simplified but also the strength and durability of the separation wall can be enhanced.

In addition to the foregoing, with the improved structure of the meltable material holder, the troublesome operations to remove the residual non-molten material stuck to the preheating flue and clean the same can be facilitated, thus resulting in an enhancement of the durability of the furnace body and the thermal efficiency to the meltable material. Consequently, the productivity can be increased.

The invention is particularly useful and advantageous for the kind of furnace in which the melting metal holder having an open lower end is provided in the preheating flue with a space from the wall surface portion of the flue on the opposite side to the metal melting burner.

What is claimed is:

1. A metal melting furnace comprising a preheating flue which is provided on its upper portion with a meltable material inlet opening and on its lower portion with an inclined hearth defined at least in part by a furnace wall and a material melting burner which is oriented toward the lower portion of the preheating flue, a molten metal reservoir, and a temperature maintaining burner which provided in the molten metal reservoir, so that a meltable material which is introduced in the preheating flue is heated and melted by the material melting burner and is moved along and on the inclined hearth into the molten metal reservoir in which the temperature of the molten metal is maintained by the temperature maintaining burner, wherein a separation wall is provided between the inclined hearth and the molten metal reservoir to define a molten metal processing portion in a form of a chamber disposed between the separation wall and the furnace wall, said separation wall being provided with connecting passage for the molten metal, between the molten metal reservoir and the molten metal processing portion, at a height level higher than a bottom surface of the molten metal processing portion, said separation wall being provided on its upper portion with an exhaust gas passage which permits exhaust gas discharged from the molten metal reservoir to pass therethrough, and wherein an inspection opening with a door is provided in a furnace wall surface to open into the molten metal processing portion.

2. A metal melting furnace according to claim 1, wherein a bottom surface of the molten metal reservoir is substantially flush with the lower side of the connecting passage for the molten metal.

3. A metal melting furnace according to claim 1, further comprising a meltable material holder having an open lower end, which is provided in the preheating flue and is spaced at least from the wall surface of the preheating flue that is located on the opposite side to the material melting burner.

4. A metal melting furnace according to claim 1, further comprising a meltable material holder having an open lower end, which is provided in the preheating flue and is spaced from the entire peripheral wall surface of the preheating flue.

5. A metal melting furnace according to claim 3, wherein the meltable material holder is made of a cylindrical sleeve.

6. A metal melting furnace according to claim 1, wherein the inclined hearth is defined by a continuously inclined surface toward the molten metal processing portion.

* * * * *